US007703178B2

(12) United States Patent
Lee

(10) Patent No.: US 7,703,178 B2
(45) Date of Patent: Apr. 27, 2010

(54) HINGE

(76) Inventor: Hoong Thye Eldon Lee, 19 Jalan Bingka, Singapore (SG) 588916

( * ) Notice: Subject to any disclaimer, the term of this patent is extended or adjusted under 35 U.S.C. 154(b) by 522 days.

(21) Appl. No.: 11/573,354

(22) PCT Filed: Aug. 6, 2004

(86) PCT No.: PCT/SG2004/000238

§ 371 (c)(1),
(2), (4) Date: Feb. 6, 2007

(87) PCT Pub. No.: WO2006/014139

PCT Pub. Date: Feb. 9, 2006

(65) Prior Publication Data

US 2007/0220707 A1 Sep. 27, 2007

(51) Int. Cl.
*E05D 5/02* (2006.01)

(52) U.S. Cl. ..... 16/387; 16/382

(58) Field of Classification Search ..... 16/386, 16/387, 389, 392, 260, 262, 380; 312/405, 312/326, 329; 49/236, 382, 388, 381
See application file for complete search history.

(56) References Cited

U.S. PATENT DOCUMENTS

| | | | | |
|---|---|---|---|---|
| 2,073,119 | A * | 3/1937 | Phiel | 16/379 |
| 2,566,872 | A * | 9/1951 | Bernhardt | 16/250 |
| 3,013,297 | A * | 12/1961 | Ferry | 16/381 |
| 4,979,264 | A * | 12/1990 | Ramsauer | 16/264 |
| 5,722,121 | A * | 3/1998 | Lau et al. | 16/381 |
| 6,151,757 | A * | 11/2000 | Beals et al. | 16/380 |
| 6,283,565 | B1 * | 9/2001 | Kohler et al. | 312/326 |
| 6,434,791 | B1 * | 8/2002 | Chung | 16/387 |

OTHER PUBLICATIONS

WIPO, International Search Report for PCT/SG2004/000238.
WIPO, Written Opinion of Searching Authority for PCT/SG2004/000238.

* cited by examiner

*Primary Examiner*—Chuck Y. Mah
(74) *Attorney, Agent, or Firm*—Intellectual Property Law Group LLP; Juneko Jackson; Otto O. Lee

(57) ABSTRACT

A hinge having two bases (2A/2B) on which a plurality of hollow cylinders (8) are arranged axially and spaced along each of the bases. Fixer holes (12) are provided in the bases at the spaces (10) between the cylinders to enable the hinge to be mounted directly without the need to work the mounting surface. The bases may be constructed to conceal the mounting screws (18).

15 Claims, 6 Drawing Sheets

HINGE

1. BACKGROUND OF INVENTION

The present invention relates to hinges for use generally on doors.

Traditionally butt hinges are constructed using a central pin from which two flanges extend. These hinges need to be chiseled and mortised into timber doors or recessed into metal doors with reinforcement plates. If this is fabricated in a factory, as they usually are, the hinges face the problems of alignment, trimming, cutting doors, relative hinge positions changed, etc, due to differences in floor to ceiling heights depending on location and premises.

The alternative is to customize the hinges on site but due to current hinge designs, much carpentry and metalworking is required to install the hinges into the door. This is one of the main reasons for the excessive amount of time and effort currently required to install door hinges and to mount the door to its frame.

This does not obviate the parts of the hinge from being observable on the edge of the door leaf and frame respectively.

2. SUMMARY OF INVENTION

It is an object of this invention to provide a hinge capable of being installed so that a door may be mounted to its frame with less time and effort.

The invention is a hinge comprising:

a. two bases;

b. a plurality of hollow cylinders are arranged axially and spaced along each of the bases;

c. a plurality of fixer holes located on each of the bases in the spaces between the cylinders whereby when the bases are mounted co-axially adjacent to each other the hollow cylinders on one base fits into the spaces between the cylinders in the other base.

3. BRIEF DESCRIPTION OF DRAWINGS

An example of the method in this invention will now be described by reference to the following drawings.

4. DESCRIPTION OF THE PREFERRED EMBODIMENTS

Figure 1:
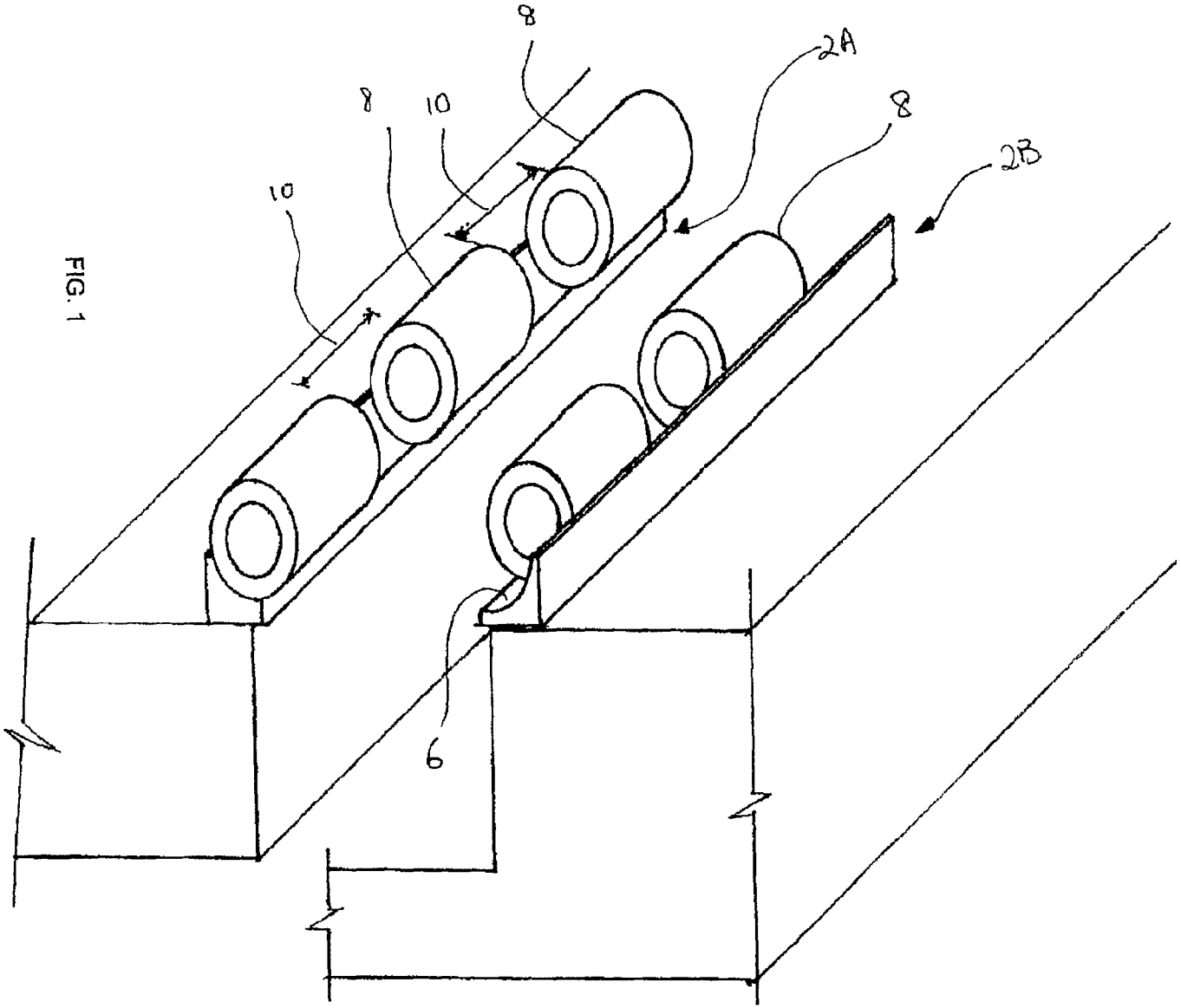
FIG. 1 is a perspective view of a preferred embodiment of a hinge secured on a door and frame in accordance with the invention.

The objective of the invention is to allow the hinge to be secured to a door and frame directly without the need to chisel or shape the door or frame to create a recess to accommodate the flanges of the hinge.

In one preferred embodiment, the hinge comprises a base 2A preferably constructed with a concave surface 6 to receive a quadrant of a hollow cylinder 8 so that the latter sits snugly in the concave surface of the base. A plurality of hollow cylinders are fixed and spaced along the base. For the ease of manufacture, the space 10 should preferably be of equal dimension.

A fixer hole 12 is machined into the concave surface of the base where the space 10 is located. The hinge would be secured to a door or frame through these fixer holes.

The hinge comprises another counterpart base 2B of a similar configuration. The hinge is completed by both bases meeting by fitting the cylinders 8 on one base 2A into the space 10 of the other base 2B.

Figure 2:
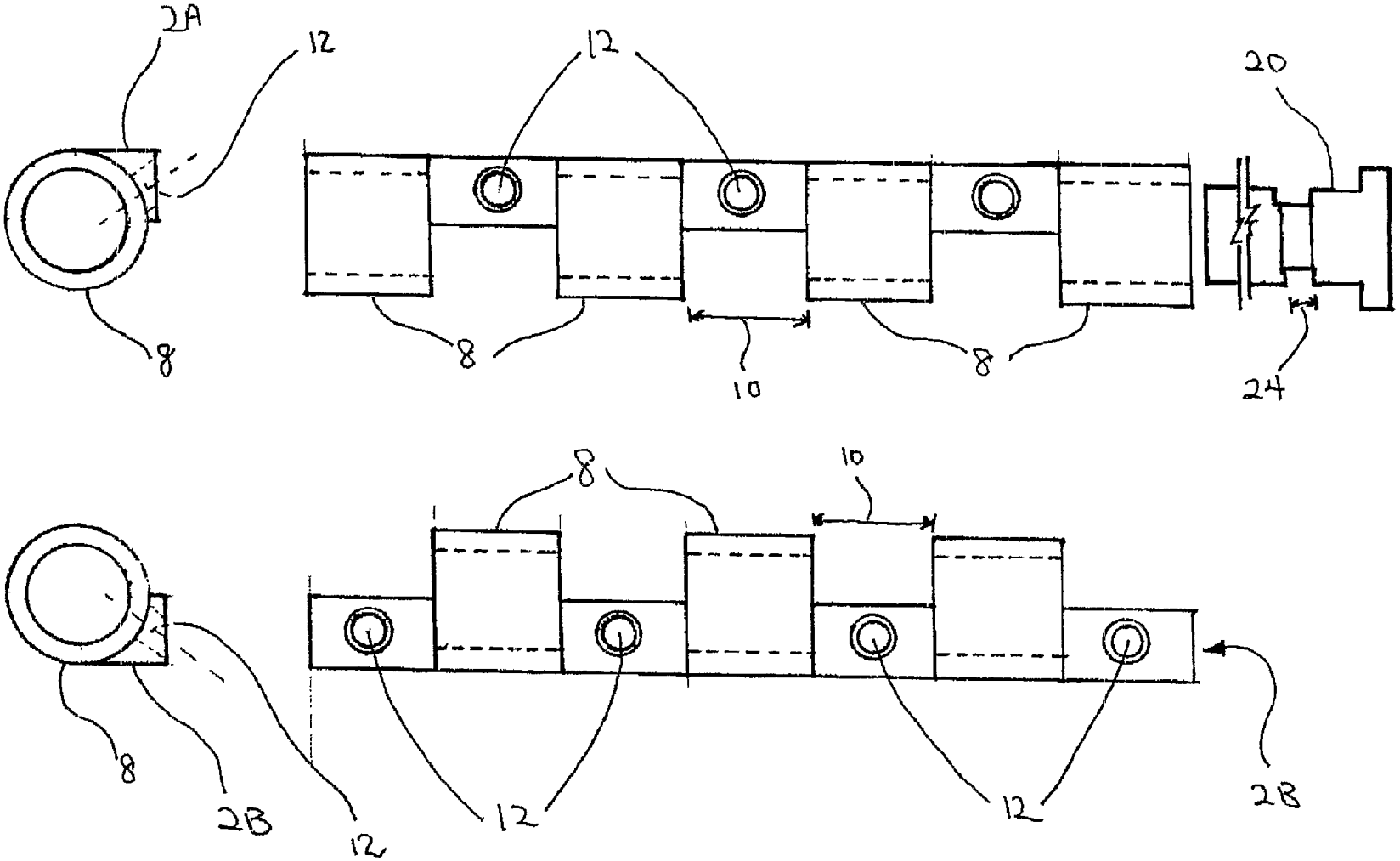
FIG. 2 is a side view of two parts of the hinge.

To install the hinge, one base 2A is mounted on a door leaf surface 14 while the other base 2B is mounted on a frame 16 by means of mounting screws 18 through the fixer hole 12. The bases are mounted close enough to each other so that the cylinders 8 on both bases are aligned into a straight row when the cylinders on one base fit into the spaces 10 on the other. Once aligned, they are held in place with a pin 20 dropped through the cylinders and secured, See FIG. 1 and FIG. 2.

Figure 3:
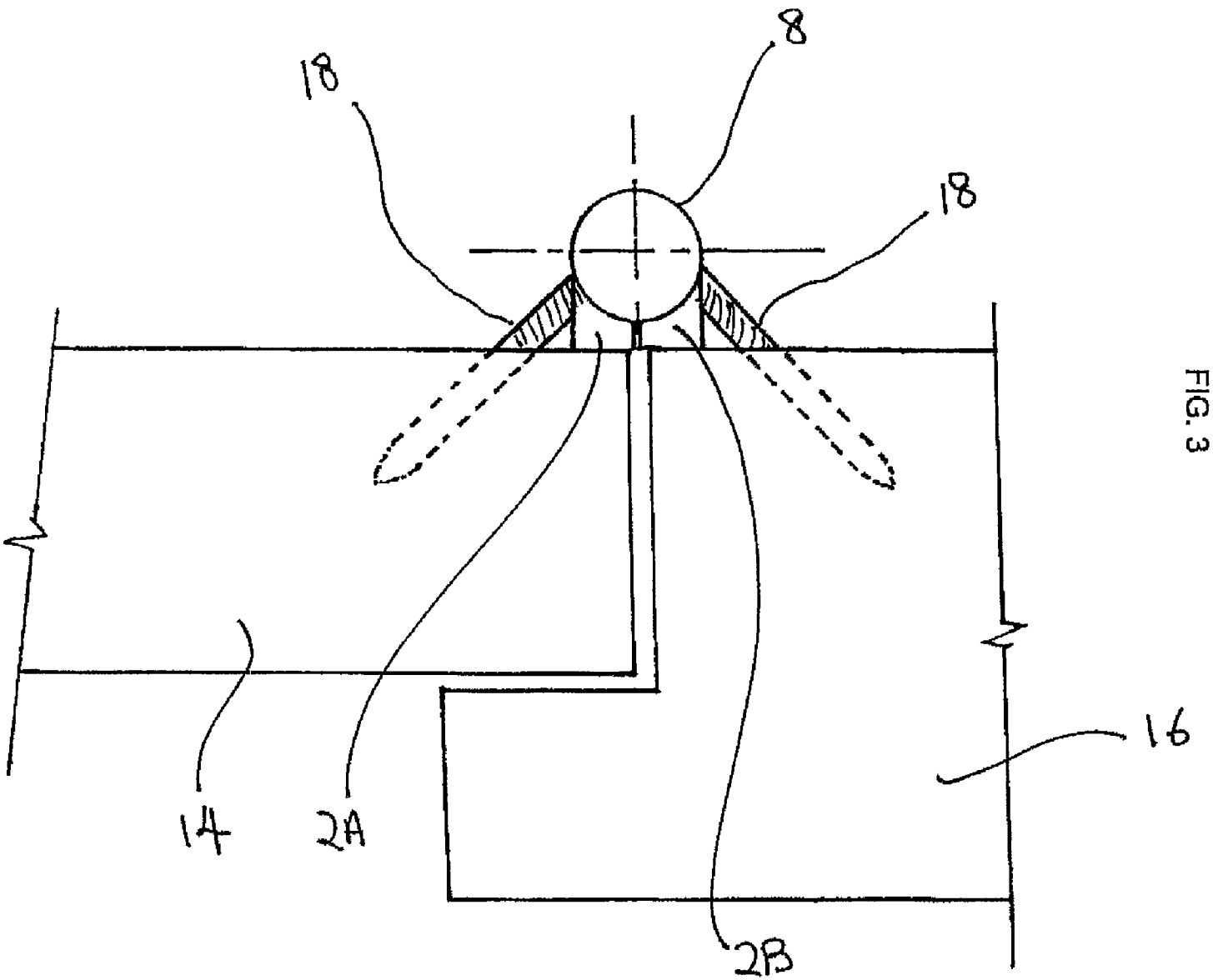
FIG. 3 is a side view of the hinge mortised into a door and frame.

The mounting screw 18 used to secure the hinge should preferably have a deep thread and short shank. It can be directly screwed through the base using it as a template. The mounting screw will penetrate the door and frame (the mounting surface) at an angle to give better stability and not let in perpendicular to the mounting surface. In this embodiment, the mounting screw, because of its angular penetration into the mounting surface, is visible between the mounting surface and the cylinder 8. See FIG. 3.

Figure 4:
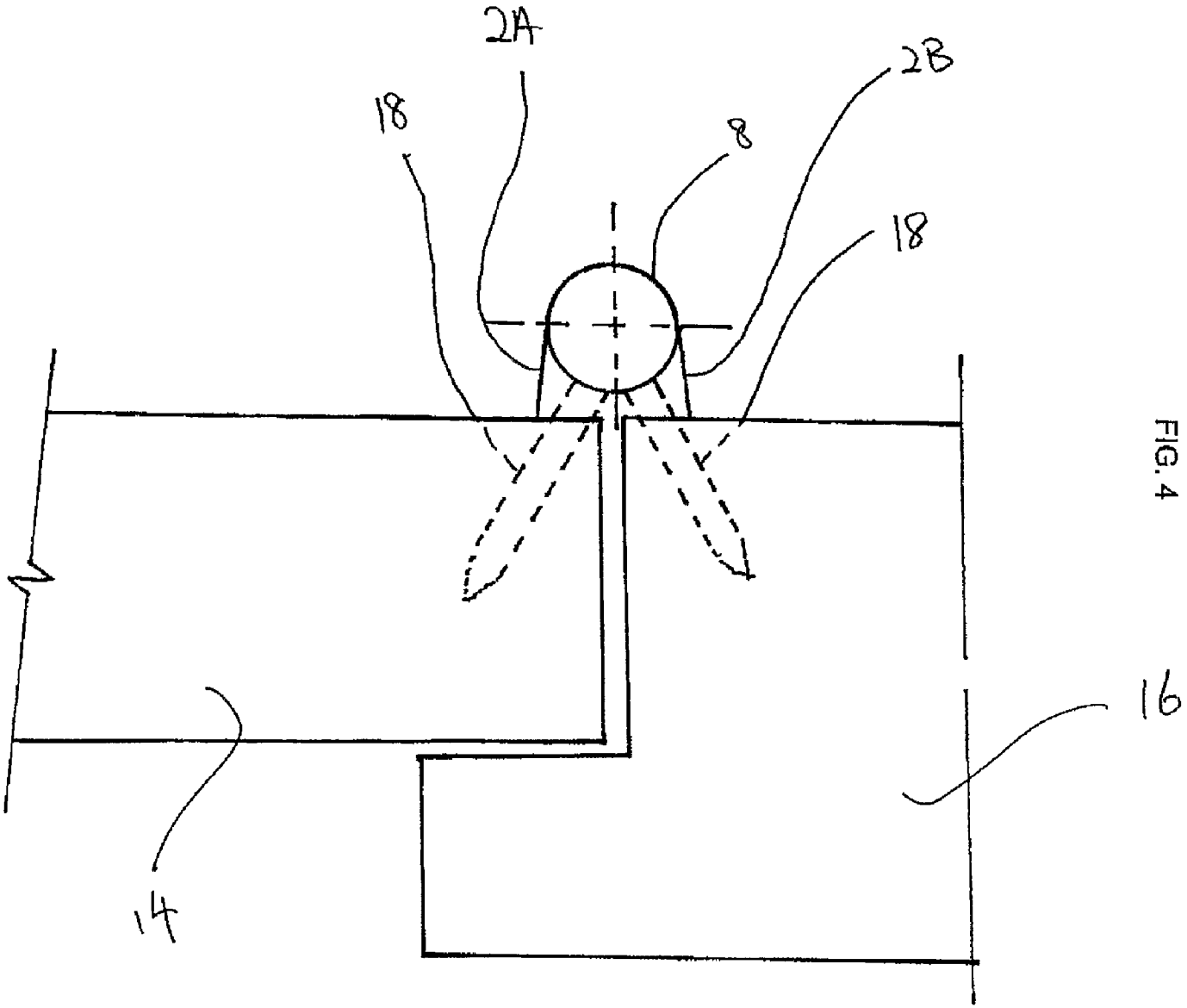
FIG. 4 is a side view of a variation of the hinge mortised into a door and frame.
Figure 5:
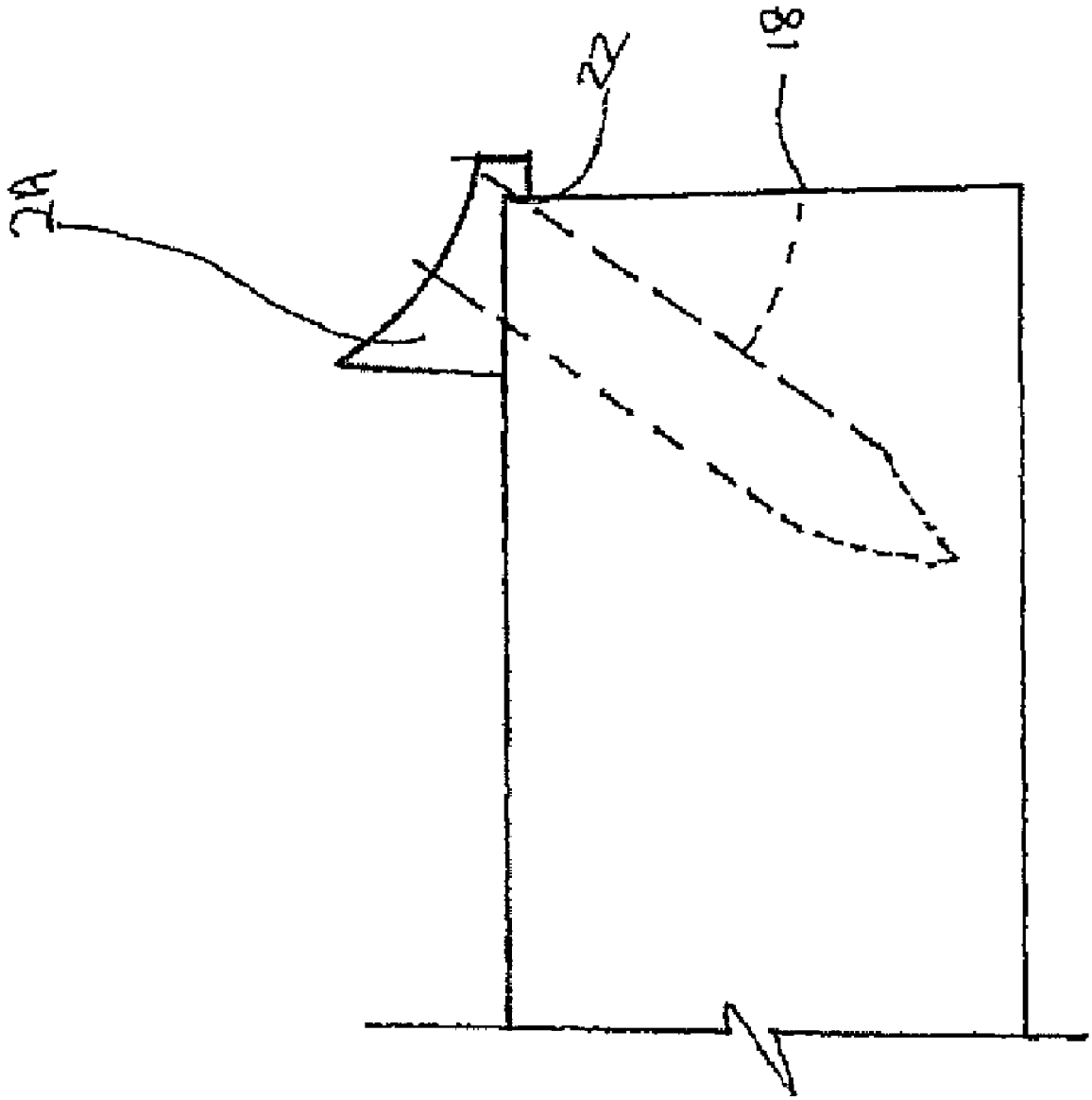
FIG. 5 is a cross-sectional view of a mounted base of the hinge without the cylinder.

This unsightly feature may be overcome by making the base 2A/2B wider at the mounting surface so as to completely conceal the mounting screw. See FIG. 4 Where the hinge has to be made more robust for heavy doors, a small rebate 22 on the base can be used to hug the edge of the mounting surfaces 14 and 16 respectively leaving a 3 mm gap (which is the industry standard) in between. See FIG. 5.

This is to allow the mounting screw 18 to be placed nearer to the edge without being visible when the door is open. In this way the mounting screw may be of a larger diameter to carry heavier load and still not be visible. This type of mounting screw is not self-tapping and requires pre-drilling. Pre-drilling can be done directly through the base 2A and 2B or with a template.

In another preferred embodiment, the hinge cylinder 8 can be shorter in length so that when assembled, gaps are visible in between. These gaps are for inserting washers or ball bearings so as to allow for smoother turning and carrying heavier load.

In another preferred embodiment, to prevent unauthorized removal of the pin 20, the pin may have a groove 24 encircling a circumference of its shank through which a safety screw may be inserted to hold the pin in place. Any attempt to remove the pin would be obstructed by the safety screw. A suitable hole may be made through a cylinder 8 in order for the safety screw to pass through. The safety screw is inserted into the hinge when the door is open and hence accessible only when the door is open. See FIG. 2.

Figure 6:
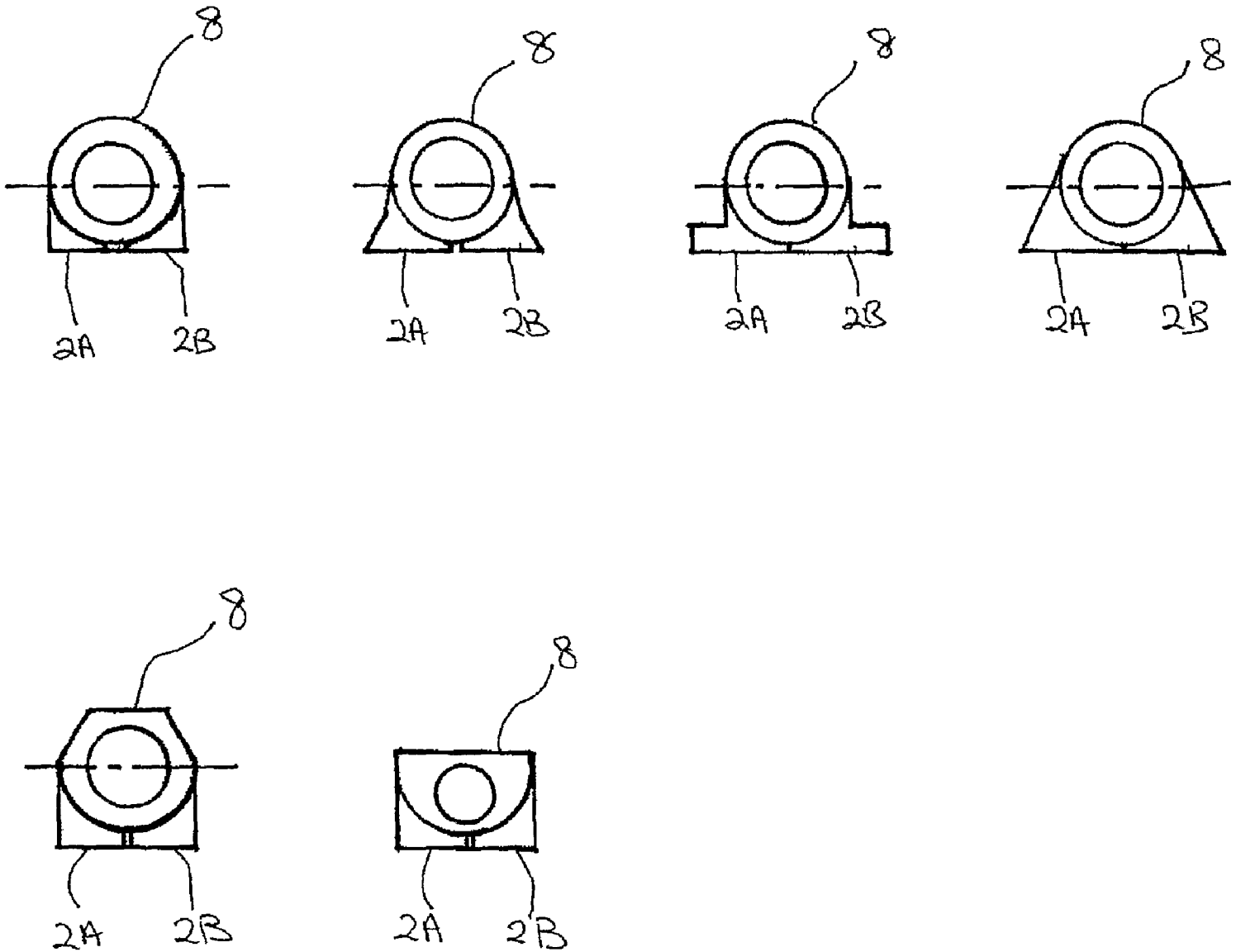
FIG. 6 is side views of various possible shapes of the hinge.

In another preferred embodiments, both the bases and cylinders 8 may take on various shapes. See FIG. 6.

The invention claimed is:

1. A hinge comprising a first base portion for attachment to a support and a second base portion for attachment to a face surface of an object to be hinged from the support, each of the bases having a plurality of hollow interspaced pivot members for receiving a pivot pin such that, on assembling the hinge, the pivot members of the first or second base portion axially interlocate with the pivot members of the other of the first or second base portion respectively to form a pivot axis of the hinge, and wherein each base portion has a plurality of fastener apertures therethrough, wherein at least one of said apertures in each base portion is positioned in a space between adjacent hollow members of the respective base portion.

2. A hinge as claimed in claim 1, wherein, when the hinge is assembled, each hollow pivot member has a length sufficient to overlap the apertures in the base portion such that, heads of fasteners inserted into the apertures used to mount the hinge are concealed by the pivot members of the other of the first or second base portion.

3. A hinge as claimed in claim 1, wherein the pivot members of each base portion are formed as co-axially aligned and spaced hollow cylindrical members for receiving the pivot pin therethrough.

4. A hinge as claimed in claim 3, wherein one or both of the base portions has a concave surface arranged to receive a corresponding curved surface of the hollow cylindrical members.

5. A hinge as claimed in claim 1, wherein either or both first and second base portions has a contact portion having a face arranged to contact a mounting surface of the object or support to which the respective base portion is to be mounted, and wherein the fastener apertures are configured at an angle non perpendicular with respect to said face such that the fasteners are arranged to penetrate through the respective base into the object or support at an angle non-perpendicular to the mounting surface.

6. A hinge as claimed in claim 1, wherein each respective base has a contact portion that completely conceals penetration of the fasteners into the respective mounting surface of the support or object.

7. A hinge as claimed in claim 1, wherein the first or second base portions has a rebate forming a longitudinal recess along an edge of the base, such that the base, when mounted, is arranged to receive and overlap a corner edge of the respective support or object to thereby strengthen the mounting position.

8. A hinge as claimed in claim 1, further comprising a hinge pin arranged for insertion through the hollow part of the members so as to hingedly retain the base portions together.

9. A hinge as claimed in claim 8, wherein the hinge pin comprises an annular groove for receiving a retaining means restricting removal of the pin out of the hollow members.

10. A hinge as claimed in claim 9, wherein the retaining means is accessible for release or removal only when the mounted hinge is in an open orientation.

11. A hinge as claimed in claim 1, wherein one of the first or second base portions is configured for attachment to a door frame and the other of the first or second base portions is configured for attachment to a front or a rear face of a door leaf.

12. A hinge according to claim 11, wherein one of the first or second base portions is arranged to be mounted to a surface of a facing leaf of the door, and the other of the first or second base portions is arranged to be mounted to a surface of a facing edge of the door frame.

13. A method of hingedly mounting a door or the like to a frame, comprising the steps of:

(a) mounting a first base portion of a hinge to a facing surface of a frame by inserting fasteners through apertures in the base portion into the frame, at least one of said apertures being disposed between adjacent axially pivot members of the first base;

(b) mounting a second base portion of the hinge to a facing surface of a leaf of the door or the like by inserting fasteners through apertures in the second base portion into the facing surface, at least one of said apertures being disposed between adjacent pivot members of the second base;

(c) arranging together the base portions such that hollow pivot members of each of the bases interlocate to form a pivot axis; and (d) inserting one or more hinge pins into the axially aligned pivot members to hingedly retain the base portions together;

wherein adjacent pivot members of one of the base portions conceals at least one of the fasteners mounting the other base portion, and vice versa.

14. A method as claimed in claim 13, further comprising the step of, when the door is open, inserting a retaining means through one of the pivot members into an annular groove of the hinge pin, said retaining means being concealed from removal when the door is closed.

15. A set of base components for a hinge comprising: a first base portion for attachment to a support and a second base portion for attachment to a face surface of an object to be hinged from the support, each of the bases having a plurality of hollow interspaced pivot members such that, on assembling the hinge, the pivot members of the first or second base portion axially interlocate with the pivot members of the other of the first or second base portion respectively to form a pivot axis of the hinge, and wherein each base portion has a plurality of fastener apertures therethrough, wherein at least one of said apertures in each base portion is positioned in a space between adjacent hollow members of the respective base portion.

* * * * *